US006109351A

United States Patent [19]

Beall

[11] Patent Number: 6,109,351

[45] Date of Patent: Aug. 29, 2000

[54] FAILSAFE CONTROL SYSTEM FOR A SUBSURFACE SAFETY VALVE

[75] Inventor: Clifford H. Beall, Broken Arrow, Okla.

[73] Assignee: Baker Hughes Incorporated

[21] Appl. No.: 09/144,121

[22] Filed: Aug. 31, 1998

[51] Int. Cl.[7] ..... E21B 34/10

[52] U.S. Cl. ..... 166/321; 166/324

[58] Field of Search ..... 166/324, 321; 137/492.5, 488

[56] References Cited

U.S. PATENT DOCUMENTS

| | | | |
|---|---|---|---|
| 4,252,197 | 2/1981 | Pringle | 166/322 |
| 4,341,266 | 7/1982 | Craig | 166/317 |
| 4,361,188 | 11/1982 | Russell | 166/381 |
| 4,373,587 | 2/1983 | Pringle | 166/324 |
| 4,448,254 | 5/1984 | Barrington | 166/373 |
| 4,660,646 | 4/1987 | Blizzard | 166/321 |
| 4,676,307 | 6/1987 | Pringle | 166/322 |
| 5,127,477 | 7/1992 | Schultz | 166/336 |
| 5,310,004 | 5/1994 | Lesimer | 166/321 |
| 5,415,237 | 5/1995 | Strattan | 166/375 |
| 5,564,501 | 10/1996 | Strattan et al. | 166/375 |
| 5,906,220 | 5/1999 | Thompson | 137/492.5 |

FOREIGN PATENT DOCUMENTS

| | | |
|---|---|---|
| 2159193 | 11/1985 | United Kingdom . |
| 2183695 | 6/1987 | United Kingdom . |

OTHER PUBLICATIONS

Camco Products & Services Brochure, "The Deepwater Specialist" (pp. 1–9; 1997).

*Primary Examiner*—Hoang Dang
*Attorney, Agent, or Firm*—Duane, Morris & Heckscher LLP

[57] ABSTRACT

An improved control system, particularly useful for SSVs, is disclosed. The control system has an operating piston which acts on a flow tube to move a flapper to an open position. The flapper is spring-loaded to close when the flow tube moves up. A return spring acts on the piston to lift the flow tube to allow the flapper to close. The operating piston is exposed to a control line from the surface as well as to a bypass piston. Opposing the hydrostatic forces of the control line is a pressurized chamber with a pressure in excess of the hydrostatic pressure. A secondary chamber acts on one side of the equalizing piston and is pressurized to a pressure less than the anticipated hydrostatic pressure in the control line. The system, including the operating piston, is configured so that when leakage occurs into or out of the control system in many places, the SSV will fail toward its failsafe closed position.

21 Claims, 3 Drawing Sheets

FAILSAFE CONTROL SYSTEM FOR A SUBSURFACE SAFETY VALVE

FIELD OF THE INVENTION

The field of this invention relates to control systems, particularly those for use with subsurface safety valves (SSV) where failure of numerous components of the control system will result in a failsafe operation of the valve to its predetermined failsafe position, i.e., generally closed.

BACKGROUND OF THE INVENTION

SSVs are safety devices mounted deep within wells to control flow to the surface. They generally have many components in common. The valve member is generally a flapper which rotates 90° and is held open by a flow tube which is shiftable downwardly to turn the flapper 90° to move it away from a closure or seat. A control system is generally employed involving hydraulic pressure from the surface connected to the SSV below. In general, applied pressure opens the valve, while removal of applied pressure from the surface allows a spring acting on the flow tube to move the flow tube upwardly so that the flapper can pivot 90° to a closed position.

Various types of control systems have been employed. To reduce the size of the closure spring acting on the flow tube, chambers pressurized with a gas have been used to counteract the hydrostatic pressure from the column of hydraulic fluid in the control line that runs from the surface down to the SSV. Since the pressurized gas resists the hydrostatic force and offsets it, closure of the SSV is accomplished with a fairly small spring when the actuating piston, acting on the flow tube, is placed in hydraulic pressure balance, thus allowing the small closure spring to shift the flow tube and allow the flapper of the SSV to close.

With the advent of use of pressurized chambers having a gas on top of hydraulic liquid acting on the opposite side of an operating piston from the control line hydrostatic pressure, numerous seals had to be used. A concern then arose as to the operation of the control system if one or another of the seals in the system failed to operate properly and permitted a leakage in one direction or another. Fairly complex designs were developed to try to compensate for failure of system seals in a manner that would allow the SSV to fail in the closed position. Some of these complex systems to obtain failsafe closure in one or two failure modes, but not necessarily all or even most failure modes, are illustrated in U.S. Pat. Nos. 4,660,646 and 5,310,004. Other control systems for SSVs employing pressurized chambers would, incidentally, go to a fail-closed position in the event certain seals in the system leaked. However, such designs were not put together with the idea of ensuring that the valve would go to its failsafe closed position in the event of malfunction of most or all of a number of given system components. Typical designs showing pressurized chambers, in conjunction with control systems for SSVs, are illustrated in U.S. Pat. No. 5,564,501 and 4,676,307. Also of general interest in the area of SSV control systems are U.S. Pat. Nos. 4,252,197 and 4,448,254.

What has been lacking in these control systems is a simple design which will serve to allow normal opening and closing of the SSV while, at the same time, allow the valve to fail in the predesignated safe position in the event of an occurrence of numerous different events relating to component failures in the control system. It is, thus, the object of the present invention to present a simplified control system for normal functioning of an SSV between an open and closed position. It is another object of the present invention to configure the control system so that if many of its components should happen to fail, the system will either immediately or eventually, in the event of slow leaks, go to its failsafe position. It is another object of the present invention to designate the closed position of the valve as the failsafe position so that failure of many different seals within the system, which can result in leakage into or out of the control system, will result in failure which allows the SSV to go to its desired fail-closed position. These and other objectives will become more apparent to those skilled in the art from a review of the preferred embodiment described below.

SUMMARY OF THE INVENTION

An improved control system, particularly useful for SSVs, is disclosed. The control system has an operating piston which acts on a flow tube to move a flapper to an open position. The flapper is spring-loaded to close when the flow tube moves up. A return spring acts on the piston to lift the flow tube to allow the flapper to close. The operating piston is exposed to a control line from the surface as well as to a bypass piston. Opposing the hydrostatic forces of the control line is a pressurized chamber with a pressure in excess of the hydrostatic pressure. A secondary chamber acts on one side of the equalizing piston and is pressurized to a pressure less than the anticipated hydrostatic pressure in the control line. The system, including the operating piston, is configured so that when leakage occurs into or out of the control system in many places, the SSV will fail toward its failsafe closed position.

DETAILED DESCRIPTION OF THE PREFERRED EMBODIMENT

Figure 1:
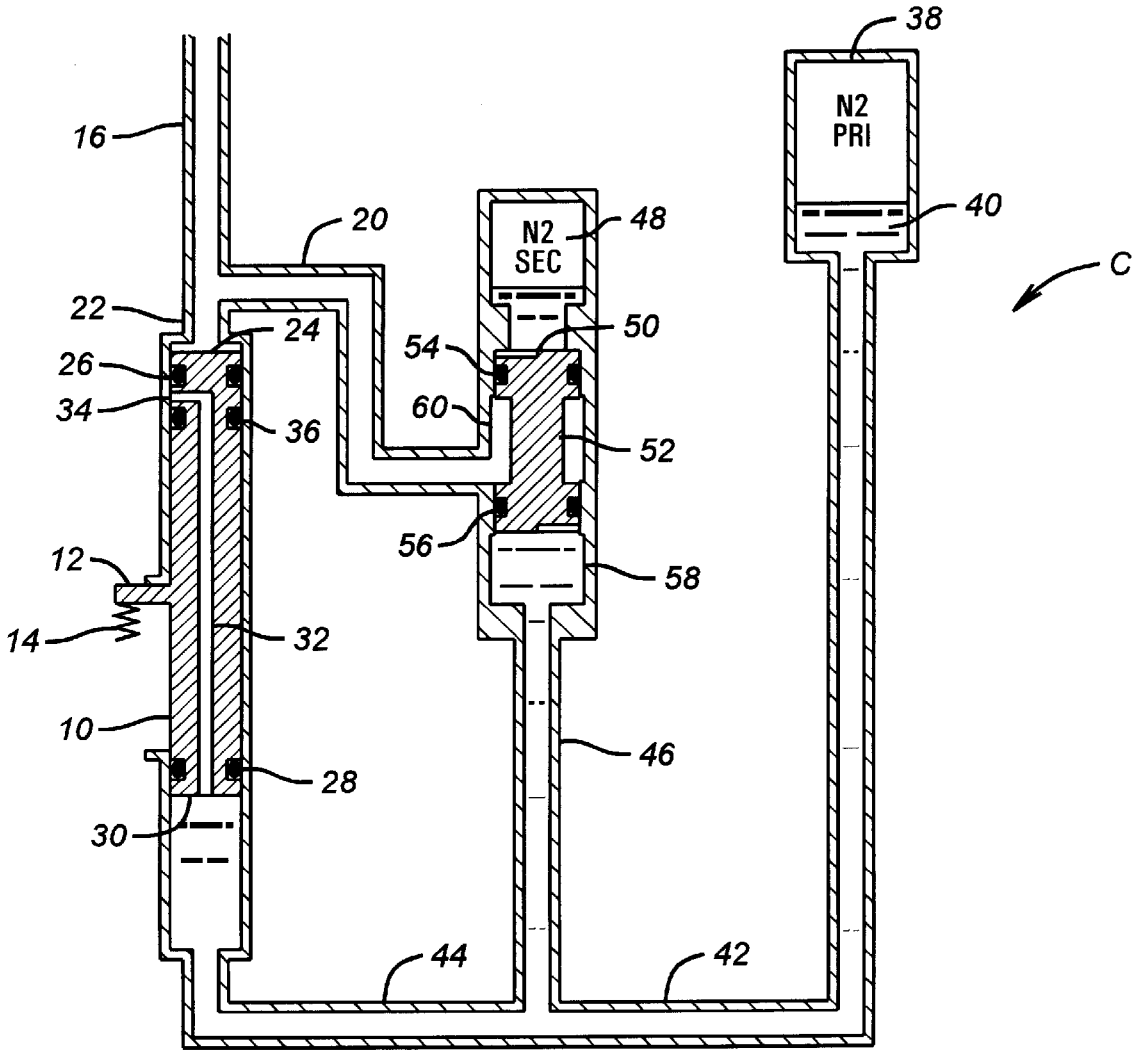
FIG. 1 is a schematic representation of the control system, leaving out the flapper and flow tube common to all SSVs and showing the SSV in the closed position.

The control system C is illustrated in FIG. 1. A piston 10 is schematically illustrated as having an extension tab 12 on which a spring 14 acts to push the piston 10 to the position shown in FIG. 1. The tab 12 is connected to a flow tube (not shown) which in turn, when pushed down, swings a flapper (not shown) so as to open the passageway in a wellbore. The structure of the subsurface safety valve (SSV) is not illustrated because it is common and well-known. The invention lies in the control system for the SSV as opposed to the construction of the SSV components themselves. Those skilled in the art will appreciate that the SSV has a housing which can include many of the components of the control system C. The control system C is accessed from the surface of the wellbore by a control line 16 which runs from the surface of the wellbore to fluid communication with conduits 20 and 22. Conduit 22 opens up to top surface 24 of piston 10. Seal 26 prevents fluid in the control line 16 from bypassing around the piston 10. Another seal 28 is adjacent the lower end of the piston 10 near surface 30. Piston 10 has a passageway 32 which extends from surface 30 to an outlet 34 between seals 26 and 36. As such, the portion of piston 10 between seals 36 and 28 is exposed to the pressure in the housing of the SSV as the piston 10 moves up or down.

A pressurized primary reservoir 38 contains a pressurized gas, preferably an inert gas such as nitrogen, above a level of hydraulic fluid 40 which communicates through a conduit 42 in turn to conduits 44 and 46. Conduit 44 allows the fluid 40 to exert a force against surface 30 of piston 10. The pressure in conduit 44 is communicated through passageway 32 to the area between seals 26 and 36. However, the pressure thus communicated through passageway 32 does not act to operate piston 10 during normal operations. In essence, as will be explained below, passageway 32 constitutes a pressure leakpath to ensure that the control system C puts the SSV in a closed position when a failure occurs at seal 36. The various types of failure modes of the control system C will be discussed in more detail below.

Figure 2:
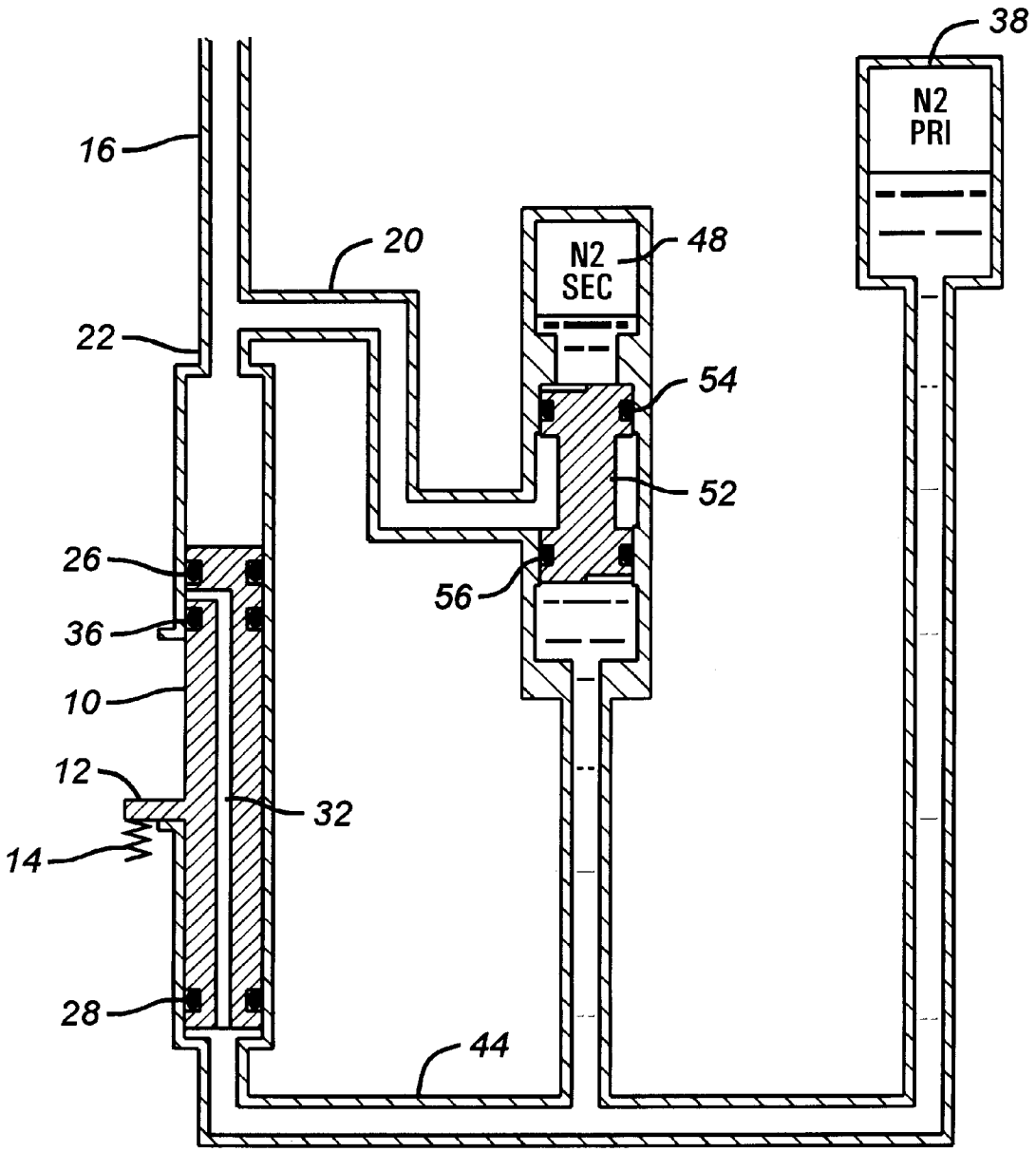
FIG. 2 is the view of FIG. 1, showing the SSV in the open position.
Figure 3:
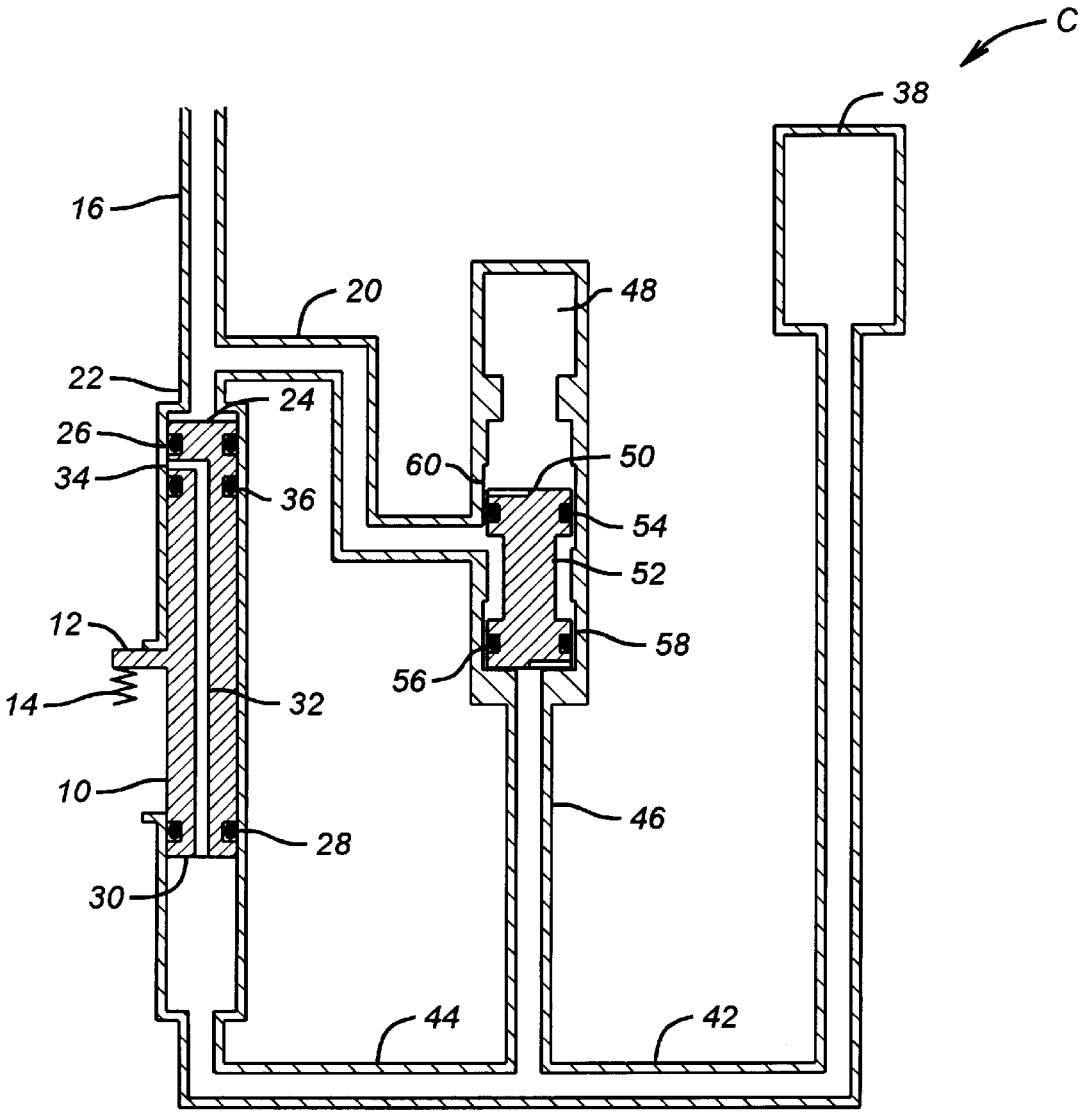
FIG. 3 is the view of FIG. 1, showing the SSV in a closed position where it cannot be reopened as a result of a failure of a component in the control system which has triggered shifting of an equalizing piston.

A secondary reservoir 48 communicates with surface 50 of equalizing piston 52. Seal 54 isolates secondary reservoir 48 from conduit 20 in the position shown in FIG. 1. Seal 56, in the position shown in FIG. 1, isolates conduit 20 from conduit 46. Between conduit 46 and piston 52, as shown in FIG. 1, there is an enlarged bore 58. There's also an enlarged bore 60 below seal 54 in the position shown in FIG. 1. The purpose of the enlarged bores 58 and 60 is to permit bypass flow around the seals 54 and 56 after piston 52 shifts. Referring to FIG. 3, when the equalizing piston 52 shifts due to failure of a variety of different components as will be explained below, seal 56 no longer seals conduit 20 from conduit 46, thus allowing pressure from the control line 16 to equalize into conduit 44 and, hence, at the bottom 30 of the piston 10. It should be noted that seal 54 no longer seals reservoir 48 because it has moved into enlarged bore 60. When this happens, the piston 10 is in pressure balance and the return spring 14 can push the tab 12 upwardly, moving the piston 10 from the position shown in FIG. 2 where the SSV is open, to the position in FIG. 3 where the SSV is closed.

The normal operation to open the SSV using the control system C requires nothing more than applying pressure in the control line 16. It should be noted that the pressure in the primary reservoir 38 is preferably above the hydrostatic pressure in the control line 16 from the hydraulic fluid therein. Ideally, and arbitrarily, the value of the pressure in the primary reservoir 38 can be 500 psi above the anticipated hydrostatic pressure in the control line 16 at the depth at which the SSV will be installed. Those skilled in the art will appreciate that the charge of pressure in primary reservoir 38, as well as secondary reservoir 48, need to be determined at the surface before the SSV is installed. The preferred pressure in the secondary reservoir 48 is below the expected hydrostatic pressure in the control line 16. In the preferred embodiment and selected for convenience, the pressure used in the secondary reservoir 48 is 50 psi less than the anticipated control line hydrostatic pressure. The purpose of the primary reservoir 38 is to offset the hydrostatic force on piston 10 from control line 16. Piston 52 is normally under a pressure imbalance which is caused by the pressure difference between reservoirs 38 and 48. The hydrostatic or applied pressure in conduit 20 has no net force impact on piston 52.

The principal components of the control system having been described, its normal operation will now be reviewed. In order to actuate the SSV from the closed position shown in FIG. 1 to the open position shown in FIG. 2, pressure is increased in control line 16. It should be noted that until the pressure in the control line 16 is elevated, the piston 10 is subject to a net unbalanced upward force from the pressure in primary reservoir 38 since it is 500 psi higher than the control line 16 hydrostatic pressure. However, upon sufficient elevation of pressure in the control line 16, to a level of approximately 2000 psi plus the primary nitrogen charge pressure in primary reservoir 38, a downward differential force exists across piston 10 which is great enough to overcome the applied upward forces resulting from the pressure in primary reservoir 38, as well as the force of the spring 14. When that occurs, the piston 10 moves downwardly, taking with it the flow tube (not shown), which in turn allows the spring-loaded flapper (not shown) to be rotated downwardly and out of the flowpath, thus opening the SSV. The final position with the SSV in the open position is shown in FIG. 2. As seen in FIG. 2, the piston 10 has traveled downwardly against the bias of spring 14 and tab 12, which is engaged to the flow tube, has moved the flow tube (not shown) down against the flapper to rotate the flapper (not shown) 90° from its closed to its open position.

The closure of the SSV occurs normally through a reversal of the procedure outlined above. The pressure in the control line 16 is reduced. When the pressure is sufficiently reduced, a net unbalanced upward force occurs on piston 10 due to the pressure in primary reservoir 38 acting on surface 30. This force, in combination with the force of spring 14, becomes greater than the hydrostatic force from the fluid column in the control line 16, thus allowing the piston 10 to move back upwardly to its position shown in FIG. 1. Reversal of movement occurs with respect to the flow tube and the flapper, thus allowing the SSV to move to a closed position. It should be noted at this time that passageway 32 is a leakpath whose purpose will be explained below. Although the pressure exerted from the gas in primary reservoir 38 acting on hydraulic fluid in lines 42 and 44 communicates with passage 32, the existence of passage 32 has no bearing on the net upward force exerted on piston 10. Accordingly, when seals 26 and 36 are in proper working order, there is simply a dead end to passageway 32 such that surface 30 of piston 10 acts as if it were a solid surface, making the net force applied by gas pressure in primary reservoir 38 act, through an intermediary fluid, on the full diameter of surface 30 during normal operations.

Potential problems can occur in the control system when the SSV is in the closed position shown in FIG. 1 or when it is in the open position as shown in FIG. 2. What proceeds is a detailed discussion of what occurs when different components of the system fail when the control system is either in the position shown in FIG. 1 or in FIG. 2. To begin, the failures will be analyzed with respect to the closed position for the SSV illustrated in FIG. 1.

The first failure mode to be discussed is a failure of seal 26 or seal 56. If seal 26 fails, the pressure in the control line 16 will increase as the pressure in primary reservoir 38 is approximately 500 psi higher than the hydrostatic pressure in the control line 16. With a leakage around seal 26, flow through passage 32 around leaking seal 26 will occur into the control line 16, building its pressure. As this occurs, the pressure in primary reservoir 38 will decline. For a time as this is occurring, the SSV should remain operational if there are no other leaks since the pressure in the reservoir 38 must leak to a pressure approximately 150 psi less than the pressure in secondary reservoir 48 before the piston 52, because of the way it is configured, can shift downwardly to the position shown in FIG. 3 to equalize line 20 and line 44. As previously stated, the pressure in reservoir 48 is approximately 50 psi below the anticipated control line hydrostatic pressure. Due to normal seal friction of the seals 54 and 56, an approximately 150 psi differential pressure is required across piston 52 to shift it downwardly to the position shown in FIG. 3. Those skilled in the art will appreciate that once the seal 56 moves into enlarged bore 58, an open passage occurs between conduits 20 and 44, equalizing the pressure on piston 10 and allowing return spring 14 to hold the piston 10 in the position shown in FIG. 1. Once the piston 52 has shifted to the position shown in FIG. 3, an increase in the control line pressure in control line 16 will not cause the SSV to open.

Those skilled in the art can see that if seal 56 on piston 52 develops a leak, equalization between lines 20 and 44 will occur around the piston 10, preventing it from shifting downwardly upon an elevation in control line pressure in line 16.

Another failure mode with the SSV in the closed position can occur if seals 36 or 28 fail. If this occurs, and the reservoir pressure in reservoir 38 exceeds the tubing pressure in which the SSV is mounted, the result will be a drop in the reservoir 38 pressure to a point approximately 150 psi below the pressure in the secondary reservoir 48. When that kind of a pressure drop has occurred in reservoir 38, the piston 52 will shift, equalizing conduits 20 and 44, preventing the SSV from operating. Until the pressure in reservoir 38 drops to approximately 150 psi below the pressure reservoir 48, the SSV will still continue to operate normally. With the shifting of piston 52, the SSV is in the failsafe closed position, which entails an equalization of pressure around the actuating piston 10, which in turn allows the spring 14 to move the tab 12 to shift the flow tube up to allow the flapper to close. The flapper cannot be opened now in view of the shifting of piston 52.

In the event the seals 28 or 36 fail to operate and the pressure in the tubing exceeds that of the reservoir 38, a leakage in either of the seals 28 or 36 will result in a net inflow into conduits 44 and 42. In this situation, the SSV will continue to be operational; however, in view of the increase in the operating pressure in reservoir 38, the necessary pressure applied in control line 16 will have to increase in order to open the SSV. If the pressure in reservoir 38 rises to a sufficient level, the equipment at the well surface may be limited in its pressure output such that it cannot raise the pressure in control line 16 to a sufficiently high level to allow the piston 10 to shift, which would in turn allow the SSV to open.

Another potential leakpath in the control system illustrated is if the reservoir pressure in reservoir 38 leaks out to the surrounding annulus due to a failure in the reservoir wall, for example. In this situation, if the annulus pressure exceeds a pressure value of the secondary reservoir pressure in reservoir 48, minus 150 psi, the SSV will remain operational as piston 52 will remain stationary. However, if the annulus pressure is less than the secondary reservoir pressure in reservoir 48 by more than 150 psi, the piston 52 will shift, equalizing conduits 20 and 44, thus preventing the opening of the SSV because piston 10 will be held to the position shown in FIG. 1 by the force of spring 14.

Another leak mode can occur around seal 54 on piston 52. When this occurs, the control line 16 has a hydrostatic pressure greater than the original pressure in reservoir 48. Thus, the pressure in reservoir 48 will build up until it equalizes with the control line 16 hydrostatic pressure. Since the SSV is closed in this scenario, when seal 52 leaks there is no applied pressure in control line 16. Later, when pressure is applied in control line 16 to try to open the SSV, the pressure in reservoir 48 will build up due to leaking seal 52. There's no effect on the operation of the control system until the pressure in reservoir 48 becomes approximately 150 psi greater than the pressure in reservoir 38, at which time piston 52 will shift to the position shown in FIG. 3, equalizing conduits 20 and 44, thus ensuring that the piston 10 stays in or moves to the position shown in FIG. 1 under the force of spring 14.

Another possible leak mode can occur from the secondary reservoir 48 to the annulus. The incident of such a leak is unlikely because such a leak will generally only occur through a fill port plug and check valve (not shown) which are connected to the secondary reservoir 48 for the purposes of applying the necessary initial charge of pressure. A loss of pressure from the secondary reservoir 48 into the annulus will not affect the operation of the SSV so as to keep it from being opened. However, the failsafe feature of the control system will no longer be present such that when any loss occurs of pressure from reservoir 38, there will no longer be an available differential pressure on piston 52 to urge it to the position shown in FIG. 3, where an equalization between conduits 20 and 44 could occur. Those skilled in the art will appreciate that it is possible to decrease the likelihood of any such leak by using redundant consecutive seals in series to seal off the fill port.

Referring now to FIG. 2, the various failure modes with the SSV in the open position will be described. The first failure mode is a failure of seal 26 or seal 56. If seal 26 leaks, the higher pressure in control line 16 will communicate through passage 32 to the primary reservoir 38, raising its pressure. In this situation, the SSV will remain in the open position shown in FIG. 2, but the requisite pressure in the control line 16 to hold it open will increase. A point can be reached where surface equipment will be unable to provide sufficient pressure in control line 16 to hold the piston 10 in the open position shown in FIG. 2. If this occurs, the SSV will close due to insufficient available pressure in control line 16 to resist the heightened pressure in reservoir 38. If seal 56 fails, conduit 44 equalizes with conduit 20 so that piston 10 will be pushed up by spring 14 to close the SSV.

If a leak occurs from reservoir 38 into the tubing due to failure of seals 28 or 36, the resulting pressure in chamber 38 could eventually decrease to approximately a level of 150 psi less than the preset pressure in secondary reservoir 48. If the reduction in pressure in reservoir 38 occurs to this extent, the piston 52 will shift to the position shown in FIG. 3, equalizing conduits 20 and 44, allowing spring 14 to close the SSV by shifting tab 12 on piston 10. The SSV remains operational and open until the reservoir 38 pressure is reduced to approximately 150 psi below the reservoir 48 pressure.

The reverse of the situation in the previous paragraph can occur when the tubing pressure exceeds the pressure in reservoir 38 and seals 28 or 36 fail. In this situation, the reservoir 38 pressure will increase. As a result, the SSV remains open and operational; however, the control line 16 pressure required to keep the piston 10 in the open position for the SSV shown in FIG. 2 will necessarily increase. Should the required control line 16 pressure exceed the available capacity of the surface equipment, the SSV will close due to insufficient control line pressure to keep piston 10 in the open position shown in FIG. 2.

The pressure in reservoir 38 can escape to the annulus in another failure mode. If this occurs, and the annulus pressure is at least 150 psi below the secondary pressure in reservoir 48, a sufficiently large leak will ultimately reduce the pressure in reservoir 38 to a level low enough to provide a differential pressure across piston 52 to shift it from the position shown in FIG. 2 to the position shown in FIG. 3. This will equalize conduits 20 and 44, allowing spring 14 to push tab 12 upwardly, bringing the flow tube up and letting the flapper rotate to the closed position. The SSV is now closed and cannot be reopened.

Another failure mode, with the SSV in the open position depicted by FIG. 2, is a leak from the control line 16 to the reservoir 48 due to a failure of seal 54. When this occurs, the pressure in reservoir 48 will built up. If the build-up in reservoir 48 is to a level 150 psi greater than the pressure in primary reservoir 38, piston 52 will shift to the position shown in FIG. 3, equalizing conduits 20 and 44. This will allow spring 14 to push tab 12 upwardly, allowing the flapper to rotate to the shut position. The SSV is now permanently closed.

Yet another potential failure mode is a loss of pressure from secondary reservoir 48 to the annulus. This type of a leak is unlikely since it will have to occur around a fill port plug and check valve (not shown) which are used in the filling procedure for reservoir 48. As previously stated, a loss of secondary pressure in reservoir 48 precludes the piston 52 from shifting to the position shown in FIG. 3 for equalization of conduits 20 and 44. In essence, with the SSV in the open position shown in FIG. 2 and a loss of pressure out of reservoir 48, the failsafe feature is no longer present in the valve. The valve will continue to function and remain in the open position. Such leakage can be minimized by use of additional redundant seals in series.

Various scenarios of failures in the control system have been described. With the exception of pressure loss from the secondary reservoir 48, the failsafe feature of piston 52 remains operational, whether it is immediately or later triggered. As described, in some situations the valve may remain operational with the failsafe feature also operational. With the valve in the closed position, the various failures will allow the valve to continue to stay in the closed position, and in some situations, depending on the degree of leakage, will allow the valve to be opened (with the failsafe system using piston 52 still operational), while in other situations, the SSV, with the control system as depicted in FIGS. 1–3, will have to be retrieved to the surface to be repaired for subsequent use.

One of the advantages of the control system as described is its simplicity and, hence, its reliability. A simple movable piston 52 responds to differential pressure to equalize around the main operating piston 10 in a variety of failure conditions as described above. The use of passage 32 allows communication from the control line 16 to the reservoir 38 in the event of a failure of seal 26. Similarly, passage 32 also serves the purpose of communicating pressure from the tubing, where the SSV flapper is located, to the reservoir 38 in the event of failure of seal 36. The pressure in reservoir 38 effectively acts across the entire bottom surface 30 of piston 10 during normal operations because passageway 32 is closed between seals 26 and 36.

The simplicity of the control system is more readily appreciated when compared to some of the prior art designs indicated in the previous description of the background of the invention. Not only are those prior designs more structurally complicated with a greater degree of moving parts, the prior art designs are also limited in their ability to respond to a variety of leakage situations and allow the SSV to obtain its failsafe condition. With the simple design as depicted, the SSV for all but the occurrence of an unlikely loss of secondary pressure from reservoir 48, retains its failsafe closure ability, even though in some conditions, depending upon the extent of the leakage, the valve may continue to be operational with the failsafe feature still in effect. In other situations where the leakage is more drastic, the failsafe feature will keep the valve closed if the leak occurs when the valve is already closed. Yet in other situations, if the leakage is sufficiently drastic, the valve will go from its open to closed position and, with piston 52 shifted, there will be no opportunity available for operating the SSV by moving piston 10, short of taking the SSV to the surface for an overhaul.

Those skilled in the art will appreciate that, although the flow tube and flapper have not been shown, the operation of the control system from the point of view of movement of tab 12 to operate a flow tube is intended to be in a manner that is well-known in the art for allowing the flapper to move between an open and closed position.

The foregoing disclosure and description of the invention are illustrative and explanatory thereof, and various changes in the size, shape and materials, as well as in the details of the illustrated construction, may be made without departing from the spirit of the invention.

What is claimed:

1. A control system for a downhole valve to place a valve member assembly mounted therein in an open and closed position, comprising:

an assembly of an actuating piston mounted in a housing with at least one seal, said assembly is operably connected to the valve member assembly said actuating piston having a first end in said housing in fluid communication to a pressure source;

a primary pressure reservoir in communication with a second end of said actuating piston in said housing such that pressure in said primary pressure reservoir acts against existing hydrostatic pressure on said first end of said actuating piston and applied pressure from said pressure source;

a pressure-equalizing mechanism in fluid communication with said pressure source and said second end of said actuating piston, said pressure-equalizing mechanism remaining in a closed position during shifting of said actuating piston with pressure applied or removed from said pressure source;

said pressure-equalizing mechanism shifting to an open position upon failure of said at least one seal on said actuating piston.

2. The control system of claim 1, wherein:

said pressure-equalizing mechanism, once shifted to said open position, cannot be reclosed by available pressure within the control system.

3. The control system of claim 2, wherein:

said pressure-equalizing mechanism comprises a movable equalizing piston having a first side exposed to pressure in said primary reservoir;

said equalizing piston mounted in a housing defining a second reservoir acting on a second side of said equalizing piston to exert an opposing force on said second piston to the force resulting from exposure of said primary pressure reservoir to said first side of said equalizing piston.

4. The control system of claim 3, wherein:

said second reservoir has a lower pressure than said primary pressure reservoir.

5. The control system of claim 4, wherein:

said primary pressure reservoir has a pressure that exceeds the existing hydrostatic pressure acting on said first end of said actuating piston.

6. The control system of claim 5, wherein:

said second reservoir has a pressure which is less than the existing hydrostatic pressure acting on said first end of said actuating piston.

7. The control system of claim 3, wherein: said equalizing piston comprises a first seal to retain pressure in said second reservoir;

said second piston comprises a second seal to selectively isolate pressure in said pressure source from the pressure in said primary pressure reservoir.

8. The control system of claim 7, wherein:

pressure in said pressure source creates balanced opposing forces on said second piston when said second piston is in said closed position.

9. The control system of claim 8, wherein:

at least said second seal on said equalizing piston moves into an enlarged bore in said housing for said equalizing piston to enable pressure equalization on said actuating piston.

10. The control system of claim 3, wherein:

said housing for said actuating piston having an open area for operable connection to the valve member assembly and said at least one seal comprises a seal above and below said opening to isolate pressure in said housing from pressure exposed to the valve member assembly;

whereupon leakage of pressurized fluid out of said housing past said seals adjacent said opening reduces pressure in said primary pressure reservoir until pressure in said second reservoir can shift said equalizing piston to its said open position to equalize fluid pressure on said actuating piston.

11. The control system of claim 10, wherein:

said actuating piston further comprises a third seal between said seal above said opening and said first end of said actuating piston and a passage extending between said seal above said opening and said third seal, on one end, to said second end of said actuating piston on the opposite end;

whereupon leakage of said seal above said opening can allow pressure from said primary pressure reservoir to deplete sufficiently to allow said second reservoir to move said equalizing piston to its said open position.

12. The control system of claim 7, wherein:

failure of said second seal on said equalizing piston equalizes pressure on said actuating piston.

13. The control system of claim 7, wherein:

failure of said first seal on said equalizing piston will allow pressure in said pressure source into said second reservoir to overcome opposing pressure on said equalizing piston so as to shift it to its open position, equalizing pressure on said actuating piston.

14. The control system of claim 3, wherein:

loss of pressure out of said primary pressure reservoir allows pressure in said second reservoir to shift said equalizing piston to its said open position.

15. In a subsurface tubing safety valve control system, having an actuating piston and related housing and seals and operably connected to a flow tube which moves a closer mechanism, said actuating piston comprising a return spring and having a first end exposed to pressure from a pressure source and a second end exposed to pressure in a primary pressure reservoir, said seals on said actuating piston isolating tubing pressure from the control system, the improvement comprising:

a bypass from said control line to a location in fluid communication with said second side of said piston and the pressure exerted thereon by said primary pressure reservoir, said bypass path running externally of said piston; and a normally closed valve in said bypass path when application and removal of said pressure source moves said actuating piston.

16. The control system of claim 15, wherein:

said valve further comprises a piston valve, said piston valve shiftable to an open position to equalize said pressure source on opposed ends of said actuating piston, and once shifted to open, stays open to preclude movement of said actuating piston with said pressure source.

17. In a subsurface tubing safety valve control system, having an actuating piston and related housing and seals and operably connected to a flow tube which moves a closer mechanism, said actuating piston comprising a return spring and having a first end exposed to pressure from a pressure source and a second end exposed to pressure in a primary pressure reservoir, said seals on said actuating piston isolating tubing pressure from the control system, the improvement comprising:

a bypass from said control line to a location in fluid communication with said second side of said piston and the pressure exerted thereon by said primary pressure reservoir;

a normally closed valve in said bypass path when application and removal of said pressure source moves said actuating piston; and failure of any one of said seals in said housing for said actuating piston will cause said piston valve to shift to its said open position.

18. The control system of claim 17, further comprising:

a secondary pressure reservoir acting on said piston valve in opposition to pressure from said primary pressure reservoir such that upon loss of a predetermined amount of pressure from said primary pressure reservoir, pressure in said secondary reservoir shifts said piston valve.

19. The control system of claim 18, wherein:

said housing for said actuating piston comprising an opening with a first seal in said housing adjacent said first end, a second seal adjacent said first seal and above said opening in said housing, and a third seal adjacent said second end of said actuating piston below said opening in said housing;

a passage through said piston, one end of which extends out of said actuating piston between said first and second seals and the other end extending to said second end of said piston;

whereupon leakage past said second seal towards said flow tube, the pressure in said primary pressure reservoir is reduced until at a predetermined level, said piston valve shifts open.

20. In a subsurface tubing safety valve control system, having an actuating piston and related housing and seals and operably connected to a flow tube which moves a closer mechanism, said actuating piston comprising a return spring and having a first end exposed to pressure from a pressure source and a second end exposed to pressure in a primary pressure reservoir, said seals on said actuating piston isolating tubing pressure from the control system, the improvement comprising:

a bypass from said control line to a location in fluid communication with said second side of said piston and the pressure exerted thereon by said primary pressure reservoir;

a normally closed valve in said bypass path when application and removal of said pressure source moves said actuating piston; and wherein said valve further comprises:

a piston valve;

a secondary pressure reservoir acting on said piston valve in opposition to pressure from said primary pressure reservoir such that upon loss of a predetermined amount of pressure from said primary pressure reservoir due to leakage of at least one of said seals, pressure in said secondary reservoir shifts said piston valve.

21. The control system of claim 20, wherein:

said piston valve comprises a first seal to isolate said second reservoir, and a second seal to isolate said pressure source from said primary pressure reservoir;

whereupon failure of either one of said seals on said piston valve, said piston valve will shift open to equalize said pressure source on said actuating piston.

* * * * *